US006169191B1

(12) United States Patent
Wieking et al.

(10) Patent No.: US 6,169,191 B1
(45) Date of Patent: Jan. 2, 2001

(54) METHOD AND DEVICE FOR OBTAINING STEARIN FROM ANIMAL OR VEGETABLE FATS

(75) Inventors: Wolfgang Wieking; Ernst Dolle, both of Oelde (DE)

(73) Assignee: Westfalia Separator AG, Oelde (DE)

( * ) Notice: Under 35 U.S.C. 154(b), the term of this patent shall be extended for 0 days.

(21) Appl. No.: 09/214,735

(22) PCT Filed: Mar. 21, 1998

(86) PCT No.: PCT/EP98/01663

§ 371 Date: Jan. 11, 1999

§ 102(e) Date: Jan. 11, 1999

(87) PCT Pub. No.: WO98/51764

PCT Pub. Date: Nov. 19, 1998

(30) Foreign Application Priority Data

May 10, 1997 (DE) ..... 197 19 776

(51) Int. Cl.[7] ..... C11B 7/00
(52) U.S. Cl. ..... 554/211; 233/14
(58) Field of Search ..... 584/211; 233/14

(56) References Cited

U.S. PATENT DOCUMENTS 2,807,411 9/1957 Ayres .
3,111,490 11/1963 Halbach .
3,341,093 9/1967 Putterlik .
3,797,736 3/1974 Günnewig .
3,902,661 9/1975 Meis et al. .

FOREIGN PATENT DOCUMENTS 0 088 949 9/1983 (EP) .
973 457 10/1964 (GB) .

*Primary Examiner*—Deborah D. Carr
(74) *Attorney, Agent, or Firm*—Henry M. Feiereisen

(57) ABSTRACT

1. Method and Apparatus for the production of stearin from fat of animal or plant origin.

2.1 A method is carried out such that during the duration of a production run, a sharp separation between the stearin phase and the oil phase is maintained at a constant rate, to achieve an optimum quality of stearin and stearin yield.

2.2. Crystallized oil of a temperature from 10 C to 40 C is fed into inlet (12) of a nozzle-type centrifuge (11) which is not self-emptying and is equipped with a stack of plates (15) and a stationary gripping device (16) for the oil phase. The solid phase is guided through flow chambers tapering towards the nozzles (20) and discharged through these nozzles. To realize a high degree of separation between the stearin phase and the oil phase, the ratio between the feed rate in I/h and the nozzle capacity in I/h is adjusted in the range between 2:1 and 4:1.

2.3 The method is used for stearin production from animal or plant fats.

3. FIG. 2.

11 Claims, 3 Drawing Sheets

METHOD AND DEVICE FOR OBTAINING STEARIN FROM ANIMAL OR VEGETABLE FATS

This application is a 371 of PCT/EP98/01663 filed Mar. 21, 1998.

The invention relates to a method for producing stearin from fat of animal or plant origin, wherein the fat is liquefied by heating it to a temperature at which crystals are no longer present in the liquid, and wherein subsequently stepwise cooling is carried out for the formation of crystals, with crystallized oil being fed into the inlet of a centrifuge equipped with a stack of plates.

The invention relates furthermore to an apparatus for carrying out the above method.

It is known to employ vacuum band filters or filter presses for separating the solid phase (stearin) from the liquid phase. Upon clogging of the filter pores, difficulties arise, in particular when the filter pores cannot be unclogged anymore, even with a vapor treatment.

It is an object of the invention to so provide a method of the above-described type as well as an apparatus for carrying out this method that during the duration of a production run, a sharp separation between the stearin phase and the oil phase is maintained at a constant rate, to achieve an optimum quality of stearin and stearin yield.

This object is solved by carrying out the cooling of the crystallized oil to a temperature in the range of 40° C. and below, but above 10° C., and by introducing the crystallized oil into the inlet of a nozzle-type centrifuge which is not self-emptying and is equipped with a stack of plates and a stationary gripping device for the oil phase; and by guiding the solid phase through flow chambers tapering towards the nozzles, and discharging the solid phase through the nozzles, with the ratio between the feed rate in I/h and the nozzle capacity in I/h being adjusted in the range between 2:1 and 4:1 for realizing a high degree of separation.

Through use of a nozzle-type centrifuge, it is sufficient to cool down the crystallized oil to a temperature in the range of 10° C. to 40° C. before introduced into the inlet of the centrifuge.

The flow chambers tapering towards the nozzles arranged in the circumferential area of the centrifugal drum are bounded by segment inserts which are made of stainless steel. These segment inserts ensure a prescribed conduction of the solid phase from the outer area of the stack of plates to the nozzles, thereby avoiding deposits of solid particles between two neighboring nozzles and also the formation of mixed phases in the solid phase chamber.

Use of the segment inserts results between the stearin phase and the oil phase in a separation which is superior to the one achieved by conventionally utilized technologies.

Additional features of the invention are set forth in the dependent claims.

An apparatus for carrying out the method according to the invention will now be described with reference to the drawing, in which.

Figure 1:
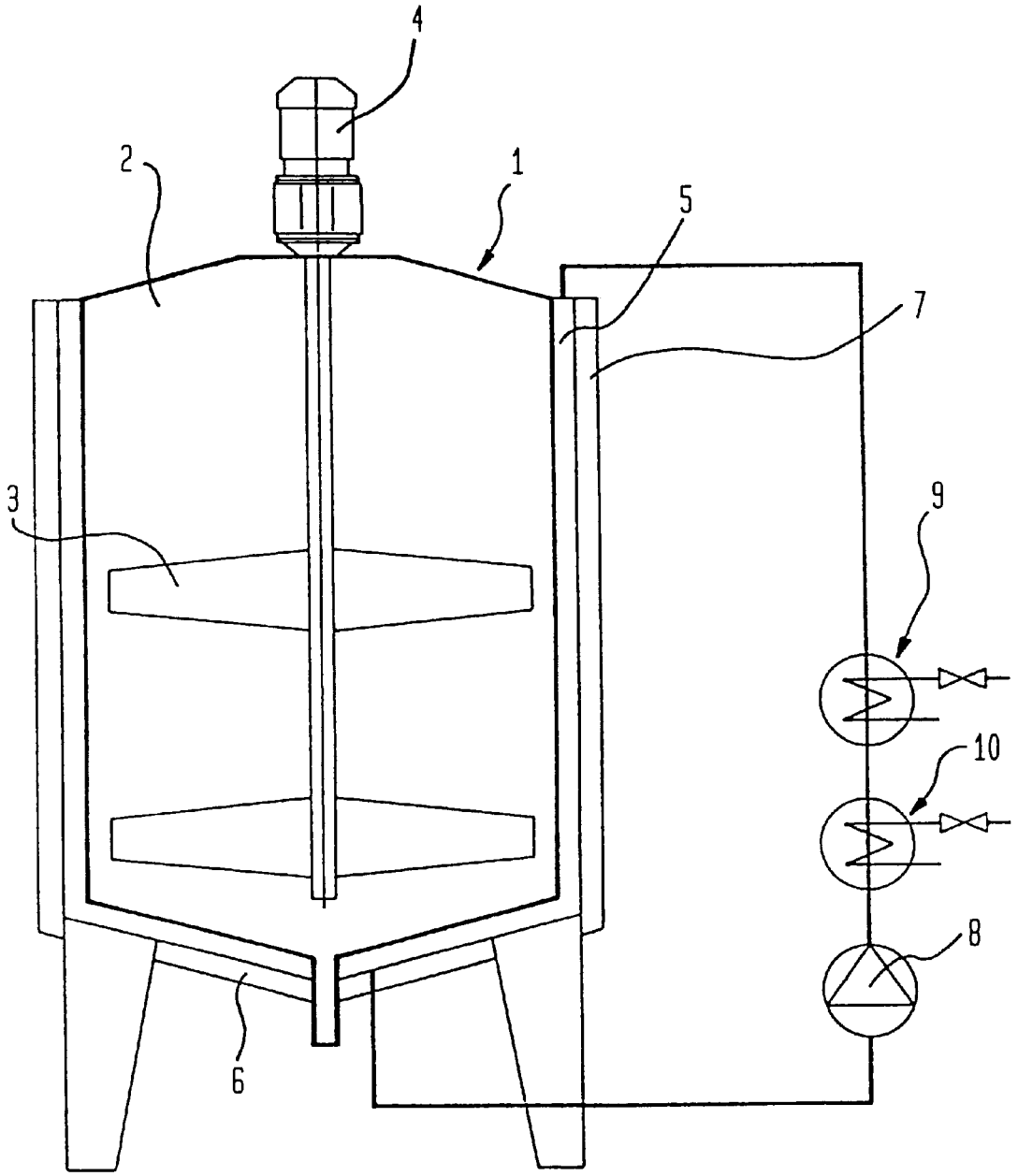
FIG. 1 shows a schematic side view of a crystallizer.

In the crystallizer 1, fat of plant or animal origin is liquefied to a temperature at which there are no crystals in the liquid. Subsequently, a stepwise cooling action is carried out to form crystals.

The crystallizer 1 includes a receptacle 2 for fat to be liquefied, which is equipped with an agitator 3 driven by a motor 4. The receptacle is equipped in its peripheral zone and bottom zone with an enclosure 5 of a heat exchange medium. This enclosure is covered to the outside in the bottom area by a heat insulation layer 6 and in the peripheral zone by a heat insulation layer 7. In the enclosure 5, the heat exchange medium is circulated by a pump 8. As heat exchange medium water is used which is either heated up by a heat exchanger 9 operated with steam, or is cooled by a heat exchanger 10 operated with ice water.

In the crystallizer 1, for example, butter oil is heated to 55° C. by means of hot water of the enclosure 5 and maintained at that temperature over a period of 30 min. while the agitator revolves at 8 rpm. In this manner, all of the oil is present in liquid non-crystallized form.

Subsequently, the oil is cooled down at a temperature differential of 15° C. until the water has reached 32° C. Further cooling of the oil is carried out at a constant water temperature until a product temperature of 36° C. is reached. This procedure is intended to prevent that too much of the oil crystallizes spontaneously. Ultimately, many evenly sized crystals are formed. The agitator revolves at 8 rpm.

As soon as it reaches 36° C., the product is slowly cooled over a period of 420 minutes at a constant temperature differential of 3° C., resulting in the preferred gentle formation of crystals. The agitator revolves at 4 rpm.

After this process step, the crystal formation has substantially concluded. The next objective is to attain the required fractionation temperature. In this exemplified embodiment, a temperature differential of 6° C. is realized at a speed of the agitator of 8 rpm until the fractionation temperature has been reached.

For plant oils and other fats, the crystallizer is operated at different temperatures.

Figure 2:
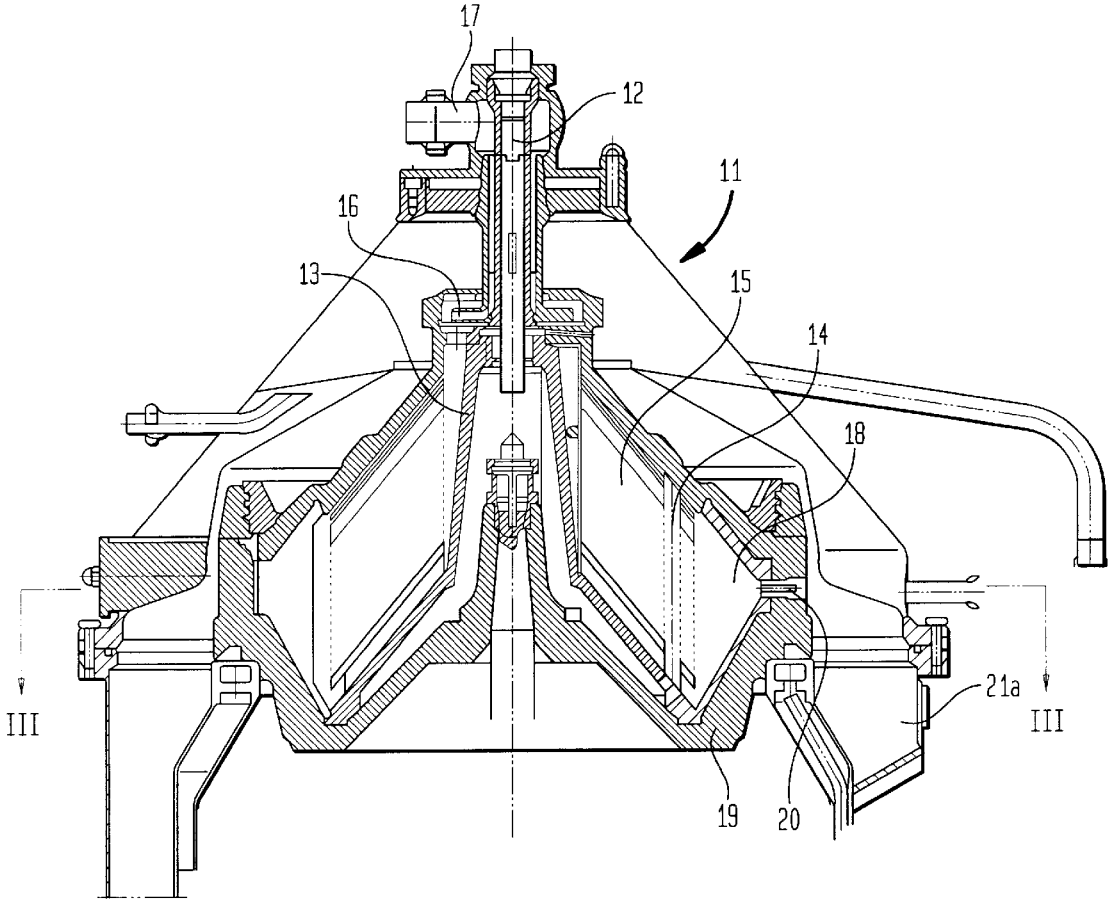
FIG. 2 shows a partial vertical view of a nozzle-type centrifuge downstream of the crystallizer.
Figure 3:
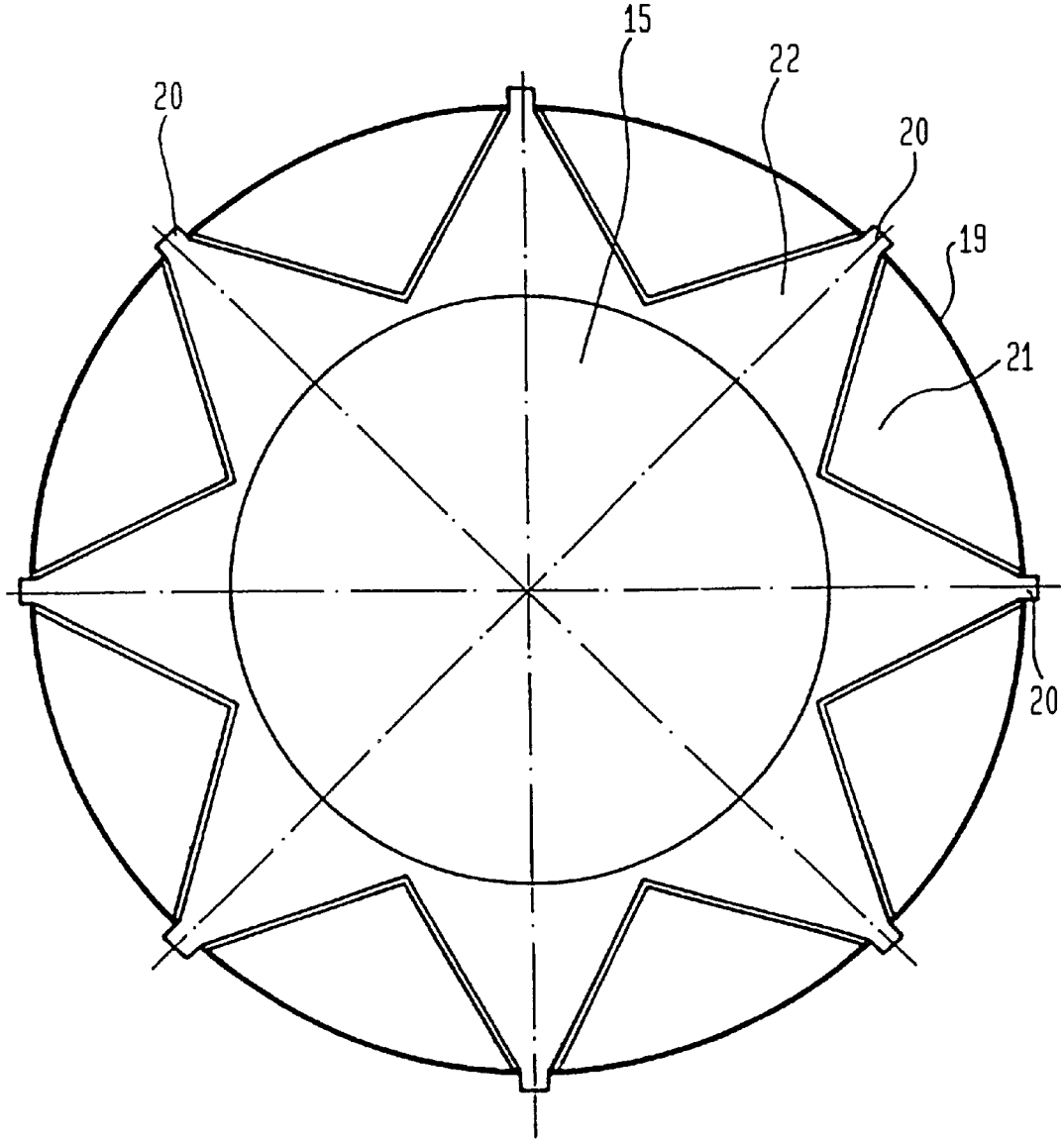
FIG. 3 shows a schematic horizontal section, taken along the line III—III of the nozzle drum.

When positioning a nozzle-type centrifuge 11 downstream of the crystallizer 1, as shown in FIGS. 2 and 3, the distribution of crystal size in the starting material is relatively uncritical, resulting in shorter crystallization periods in comparison to the use of filter units for separating the solid phase and the liquid phase.

The crystallized oil treated in the crystallizer 1 is fed to inlet 12 of the centrifuge 11 and flows from there via a distributor 13 into the riser channels 14 of a stack of plates 15. The separation of the stearin phase from the oil phase occurs in the separation chambers between the single plates of the stack of plates. The oil phase flows to the center of the centrifuge and is discharged via a stationary gripper device 16 and a pipe 17.

The stearin phase flows through the solid phase chamber 18 of centrifuging drum 19 and is discharged by nozzles 20 spaced evenly about the circumference of the centrifuging drum into a collection chamber 21.

Arranged between two neighboring nozzles 20 is a segment 21 made of stainless steel to demarcate for the solid phase a flow chamber 22 which extends from the circumferential area of the stack of plates 15 and tapers towards the nozzle 20.

Preferably, the nozzles 20 have a nozzle diameter of 0.5 or 0.6 mm. The nozzle output is about 150 I/h.

The ratio between the feed rate of the centrifuge and the nozzle output is in the range between 2:1 and 4:1.

LIST OF REFERENCE NUMERALS

1. Crystallizer
2. Receptacle

-continued

| LIST OF REFERENCE NUMERALS |
|---|
| 3. Agitator |
| 4. Motor |
| 5. Enclosure |
| 6. Heat insulation layer |
| 7. Heat insulation layer |
| 8. Pump |
| 9. Heat exchanger |
| 10. Heat exchanger |
| 11. Centrifuge |
| 12. Inlet |
| 13. Distributor |
| 14. Riser channel |
| 15. Stack of Plates |
| 16. Gripping device |
| 17. Pipe |
| 18. Solid phase chamber |
| 19. Centrifuge drum |
| 20. Nozzle |
| 21. Segment |
| 22. Flow chamber |

What is claimed is:

1. A method for obtaining crystallized solid phases from fat of animal or plant origin, comprising the steps of:

heating fat to a temperature until liquefied to form a liquid free of crystals;

cooling the liquid step-by-step to a temperature in the temperature range from 40° C. to above 10° C. to obtain a crystallized oil;

introducing the crystallized oil into a non-self-emptying nozzle-type centrifuge for separating a solid phase; and conducting the solid phase through flow chambers tapering towards nozzles of the centrifuge for discharge through the nozzles.

2. The method of claim 1 wherein the cooling step is carried out in a first phase at a temperature differential of 15° C. between the liquid and a heat-exchange medium, and in a second phase to a temperature between 40° C. and above 10° C. at a temperature differential of 3° C. between the liquid and the heat-exchange medium.

3. The method of claim 2 wherein the liquid is cooled down during the second cooling phase to a temperature of 36° C. over a period of 420 minutes.

4. The method of claim 2 wherein the liquid is agitated during the first cooling step at 8 rpm and during the second cooling phase at 4 rpm.

5. The method of claim 3 wherein the heat exchange medium is water.

6. The method of claim 1, wherein the solid phase is conducted through the flow chambers with the ratio of an input rate in liters per hour incoming crystallized oil to a nozzle output rate in liters per hour being adjusted in a range between 2:1 and 4:1.

7. The method of claim 1, wherein the crystallized solid phase obtained is stearin.

8. Apparatus for producing stearin from fat of animal or plant origin, comprising:

a crystallizer for heating fat and subsequently cooling the fat step-by-step to obtain a crystallized oil;

a non-self-emptying centrifuge positioned downstream of the crystallizer and including a centrifuging drum having accommodated therein a stack of plates for separating a solid phase from the crystallized oil, and nozzles formed circumferentially about the centrifuging drum, said solid phase being guided via flow chambers to the nozzles for discharge, with the flow chambers being so bounded by inserted segments as to taper towards the nozzles, with the ratio of an input rate in liters per hour of incoming crystallized oil to a nozzle output rate in liters per hour being adjusted in a range between 2:1 and 4:1.

9. The apparatus of claim 8 wherein the segments provided in the centrifuging drum are made of stainless steel.

10. The apparatus of claim 9 wherein the segments extend from an outer area of the stack of plates to the nozzles.

11. The apparatus according to claim 8 wherein the nozzles have a nozzle mouth at a diameter of about 0.5 mm or about 0.6 mm.

* * * * *